US007096766B2

(12) United States Patent
Hsieh

(10) Patent No.: US 7,096,766 B2
(45) Date of Patent: Aug. 29, 2006

(54) SLEEVE DEVICE WITH STEPPED STRUCTURE

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/006,226

(22) Filed: Dec. 7, 2004

(65) Prior Publication Data

US 2006/0117916 A1 Jun. 8, 2006

(51) Int. Cl.
*B25B 13/00* (2006.01)

(52) U.S. Cl. ..... 81/124.4; 81/121.1

(58) Field of Classification Search ..... 81/124.4, 81/121.1, 3.4, 120, DIG. 11
See application file for complete search history.

(56) References Cited

U.S. PATENT DOCUMENTS 1,281,438 A * 10/1918 Tuttle ..... 81/124.5
5,862,721 A * 1/1999 Kowats ..... 81/121.1
6,637,298 B1 * 10/2003 O'Brien et al. ..... 81/124.5
6,647,831 B1 * 11/2003 Hu ..... 81/60
6,792,838 B1 * 9/2004 Brooks et al. ..... 81/439
6,827,538 B1 * 12/2004 Doppke et al. ..... 411/389
6,898,999 B1 * 5/2005 Hsien ..... 81/124.6

* cited by examiner

*Primary Examiner*—Lee D. Wilson
*Assistant Examiner*—Alvin J. Grant

(57) ABSTRACT

A sleeve device comprises a sleeve portion, the sleeve portion having a first opening; a first sleeve extending from an upper side of the sleeve portion; the sleeve portion having four sides; two opposite sides of the four sides being suitable for one kind of spanner and the other two opposite sides being suitable for another kind of spanner; a second sleeve; the sleeve portion having four sides; two opposite sides of the four sides being suitable for one kind of spanner and the other two opposite sides being suitable for another kind of spanner; the first sleeve and the second sleeve being formed as a stepped structure; the second sleeve having a second opening. The second sleeve has a shape similar to that of the first sleeve and the size of the second sleeve is smaller than that of the first sleeve.

2 Claims, 5 Drawing Sheets

SLEEVE DEVICE WITH STEPPED STRUCTURE

FIELD OF THE INVENTION

The present invention relates to sleeve devices, and in particular a sleeve device with a stepped structure which is suitable for different kinds of spanners so that the user can operate the sleeve device with different kinds of spanner and thus the work can be performed easily and conveniently.

BACKGROUND OF THE INVENTION

Currently, in general, a spanner is used to rotate a screw means. If the spanner cannot apply a sufficient force to the screw means, a sleeve is used to cover upon the screw means and then a spanner is used to clamp the screw mean. Then a force is applied to the screw means through the sleeve. However generally, the sleeve is not suitable for one kind of screw means. If a suitable spanner cannot fit the sleeve, the user must search a new one. However this will make the work become tedious and even a suitable one cannot be found.

Moreover the prior art method of rotating the screw means is confined by the space. Since the sleeve is orientated in predetermined directions, the directions for applying the force are confined by the orientations of the screw means. If the space is small, the user's action will be confined in the space. It is possible that the user will collide a wall so as to affect the screwing operation. Furthermore, the working time is prolonged.

SUMMARY OF THE INVENTION

Accordingly, the primary object of the present invention is to provide a sleeve device with a stepped structure which is suitable for different kinds of spanners so that the user can operate the sleeve device with different kinds of spanner and thus the work can be performed easily and conveniently.

To achieve above objects, the present invention provides a sleeve device which comprises a sleeve portion; the sleeve portion having a first opening; a first sleeve extending from an upper side of the sleeve portion; the sleeve portion having four sides; two opposite sides of the four sides being suitable for one kind of spanner and the other two opposite sides being suitable for another kind of spanner; a second sleeve; the sleeve portion having four sides; two opposite sides of the four sides being suitable for one kind of spanner and the other two opposite sides being suitable for another kind of spanner; the first sleeve and the second sleeve being formed as a stepped structure; the second sleeve having a second opening. The second sleeve has a shape similar to that of the first sleeve and the size of the second sleeve is smaller than that of the first sleeve.

The various objects and advantages of the present invention will be more readily understood from the following detailed description when read in conjunction with the appended drawing.

DETAILED DESCRIPTION OF THE INVENTION

Figure 1:
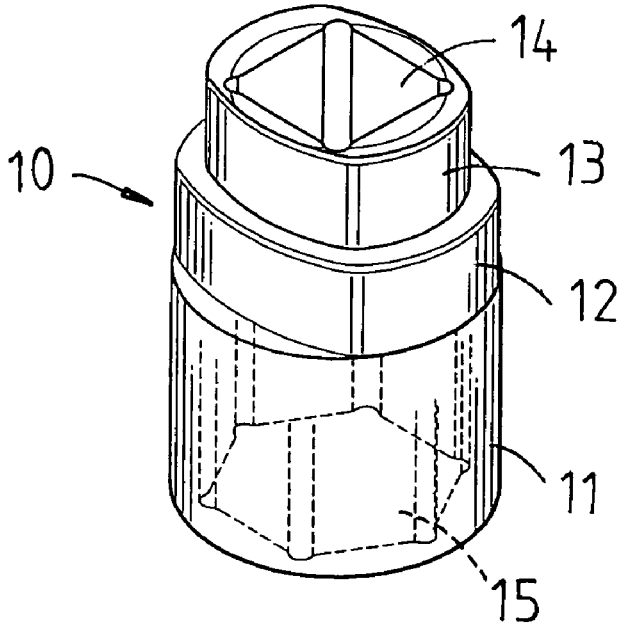
FIG. 1 is a perspective view of the present invention.
Figure 2:
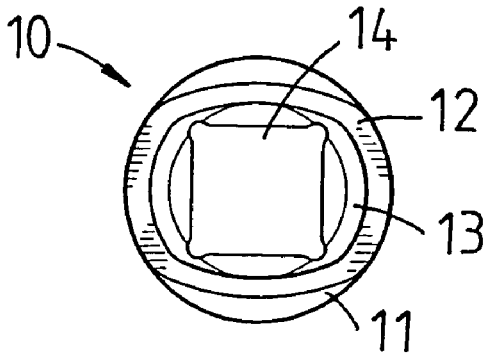
FIG. 2 is an elevational view of the present invention.
Figure 3:
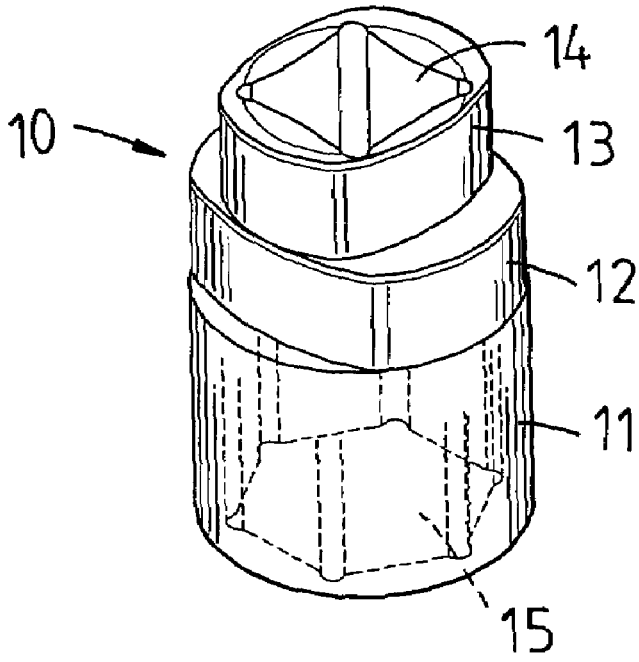
FIG. 3 is a schematic view showing the second embodiment of the present invention.
Figure 4:
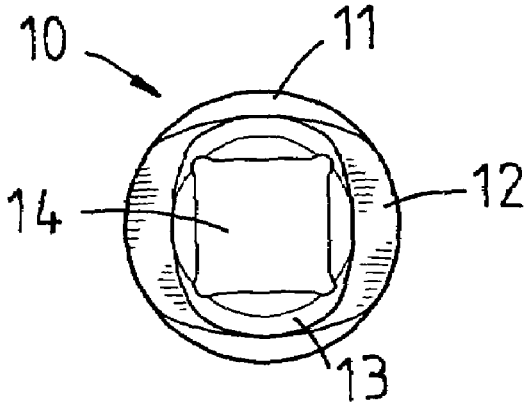
FIG. 4 is another elevational view of the second embodiment of the present invention.

In order that those skilled in the art can further understand the present invention, a description will be provided in the following in details. However, these descriptions and the appended drawings arc only used to cause those skilled in the art to understand the objects, features, and characteristics of the present invention, but not to be used to confine the scope and spirit of the present invention defined in the appended claims.

Referring to FIGS. 1 to 4, the present invention includes a sleeve device 10. The sleeve device 10 includes the following elements.

A sleeve portion 11 is included, the sleeve portion 11 has a hexagonal opening 15. The hexagonal opening 15 is suitable to receive a hexagonal screwing means, see FIG. 5.

A first sleeve 12 extends from an upper side of the sleeve portion 11. The sleeve portion 11 has four sides. Two opposite sides of the four sides are suitable for one kind of spanner and the other two opposite sides are suitable for another kind of spanner. Two opposite sides of four sides of the first sleeve 12 are matched to the edges of the sleeve portion 11.

A second sleeve 13 with a size smaller than that of the first sleeve 12 extends from an upper side of the first sleeve 12. The first sleeve 12 and the second sleeve 13 are formed as a stepped structure. The second sleeve 13 has a rectangular opening 14 which is communicated to the hexagonal opening 15. The rectangular opening 14 is suitable for receiving a D shape spanner (not shown).

The second sleeve 13 has a shape similar to that of the first sleeve 12, but the size of the second sleeve 13 is smaller than that of the first sleeve 12. In arrangement, the orientation of the second sleeve 13 may be arranged in parallel to that of the first sleeve 12.

Figure 5:
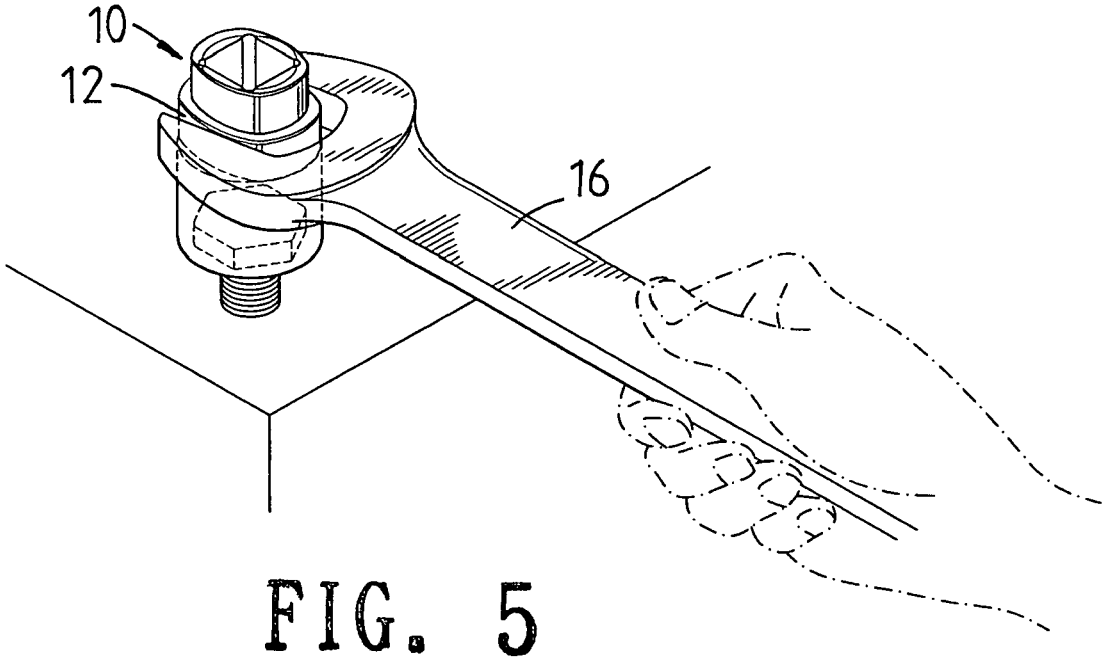
FIGS. 5 and 6 show the operation of the present invention.
Figure 6:
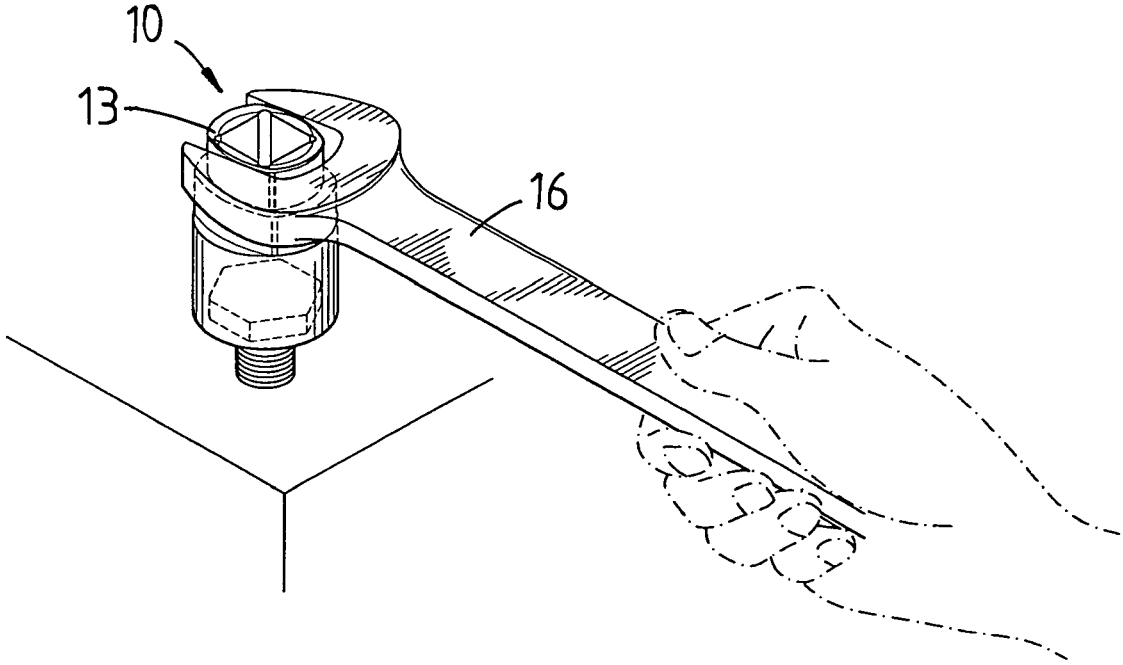

Referring to FIGS. 5 and 6, the operation of the first embodiment of the present invention is illustrated. In this embodiment, the orientation of the second sleeve 13 is parallel to that of the first sleeve 12. In use, the sleeve device 10 is engaged to a screwing means. A spanner 16 serves to clamp two opposite sides of the first sleeve 12 and then rotate the sleeve device 10. If no spanner 16 fits the two opposite sides of the first sleeve 12, a second spanner 16 is used to clamp two opposite sides of the second sleeve 13 or other two opposite sides of the first sleeve 12. Thereby the present invention provides more usages to users.

Figure 7:
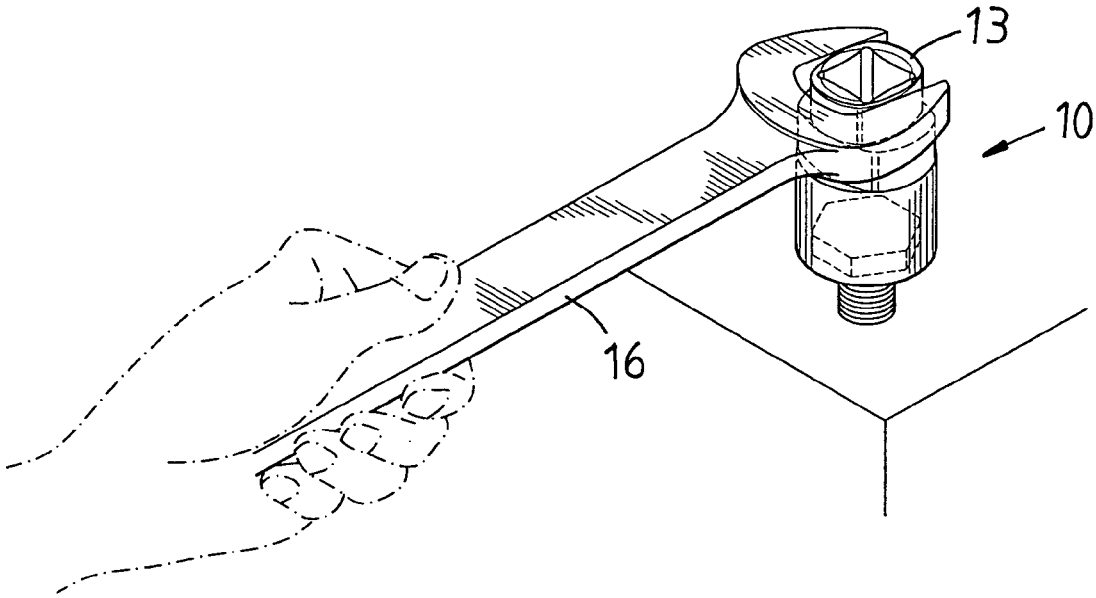
FIGS. 7 and 8 show the operation of the second embodiment of the present invention.
Figure 8:
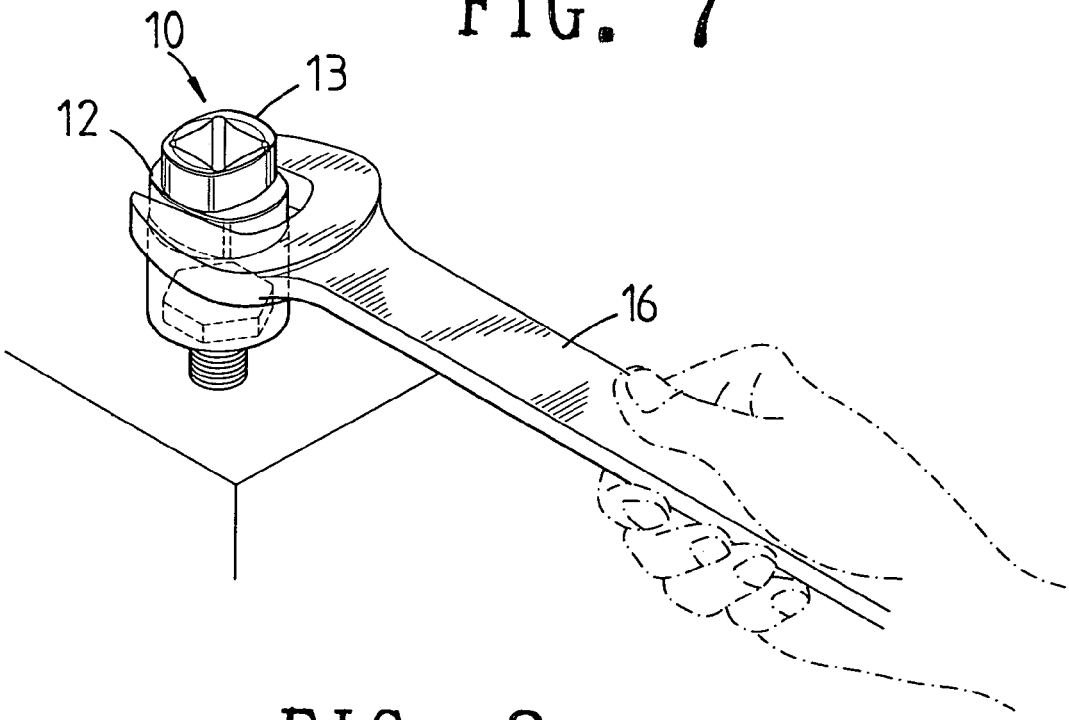

With reference to FIGS. 7 and 8, the second embodiment of the present invention is illustrated. In this arrangement, the orientation of the second sleeve 13 is vertical to that of the first sleeve 12. The use of this embodiment provides the user to operate the present invention from different orientation.

Figure 9:
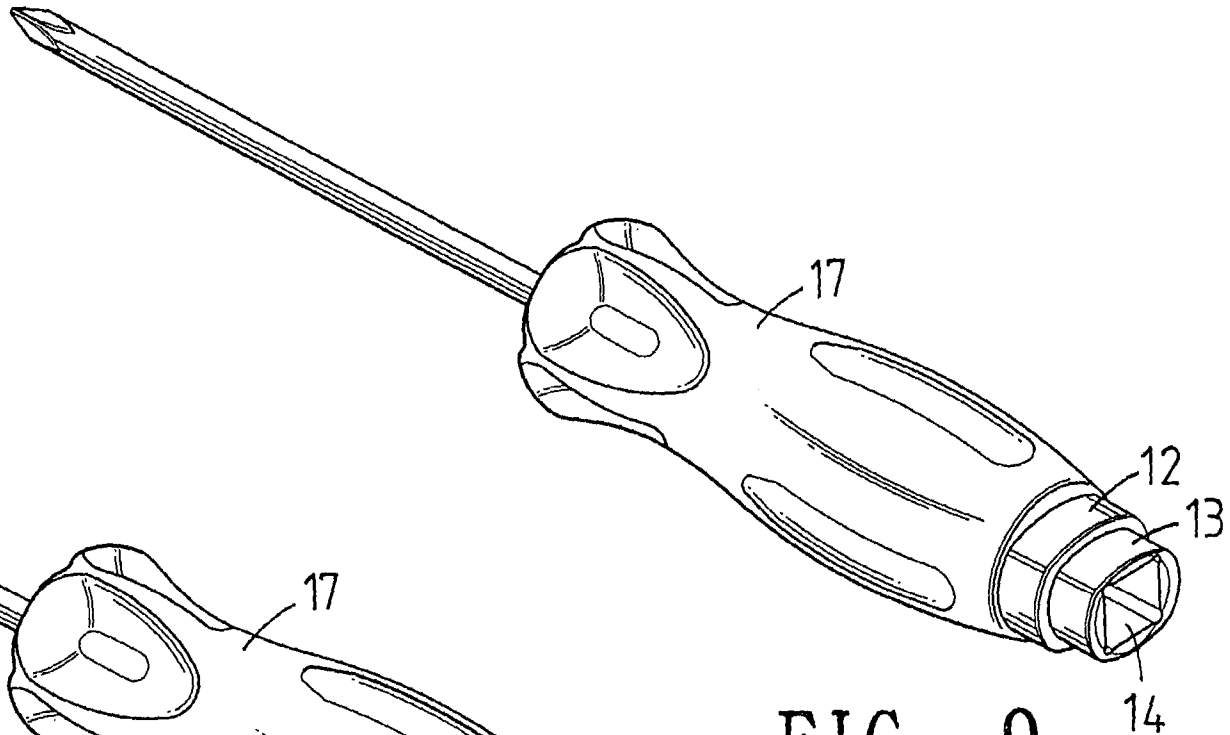
FIGS. 9 and 10 illustrate an embodiment of the present invention, where the present invention is applied to an opener.
Figure 10:
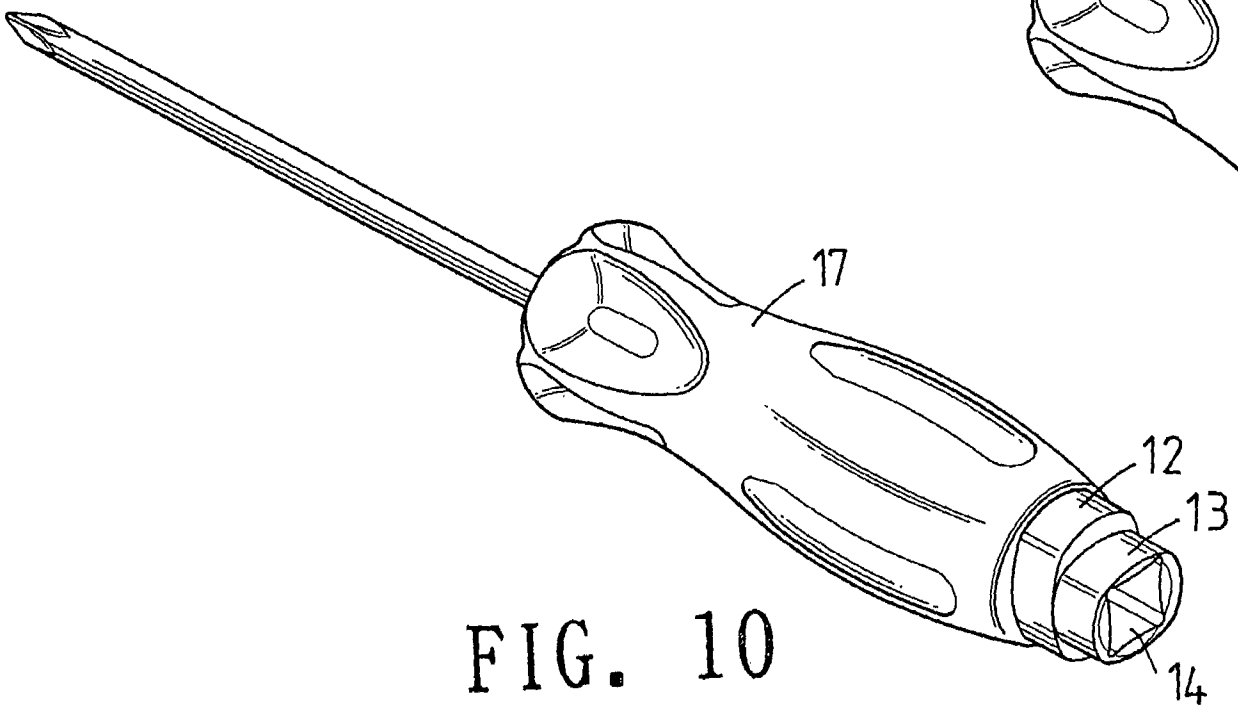

Referring to FIGS. 9 and 10, it is illustrated that the present invention is used with an opener 17. The sleeve device is installed to one end of the opener 17. The first sleeve 12 and second sleeve 13 protrude out from one end of the opener 17. When the opener 17 is used to rotate or detach a screwing means. If a great force is necessary, a spanner clamps the first sleeve 12 or second sleeve 13 for rotating the sleeve device so as to detach the screwing means. Thereby the force can be applied easily so that the hand will not hurt or the opener will not be damaged.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sleeve device comprising:

a sleeve portion; the sleeve portion having a first opening;

a first sleeve extending from an upper side of the sleeve portion; the first sleeve having four sides; two opposite sides of the four being suitable for one kind of spanner and a second pair of said four sides being suitable for another kind of spanner; wherein said two opposite sides of the first sleeve are smaller than that of the sleeve portion and said second pair of said four side is equal to an outer circumference of the sleeve portion; and a second sleeve extending from an upper side of the first sleeve; the second sleeve having four sides; two opposite sides of the four sides being suitable for one kind of spanner and the other two opposite sides being suitable for another kind of spanner; the first sleeve and the second sleeve being formed as a stepped structure; the second sleeve having a second opening; wherein the four sides of the second sleeve is smaller than that of the first sleeve.

2. The sleeve device as claimed in claim 1, wherein the first opening has a hexagonal shape and second opening has a rectangular shape.

* * * * *